United States Patent [19]

Wray et al.

[11] 4,057,145

[45] Nov. 8, 1977

[54] COMPLIANCE DISPENSER FOR ORAL MEDICATION

[76] Inventors: Betty B. Wray, 3115 Ramsgate Road; Peter F. Stager, 2404 Kings Way; Charles W. Linder, 501 Aumond Road, all of, Augusta, Ga. 30904

[21] Appl. No.: 668,537

[22] Filed: Mar. 19, 1976

[51] Int. Cl.[2] ..... B65D 85/56; B65D 83/04

[52] U.S. Cl. ..... 206/538; 220/20; 206/539

[58] Field of Search ..... 206/538, 539, 534, 528, 206/534.2, 540, 252, 1.5, 37; 220/20; 40/117; 116/121

[56] References Cited

U.S. PATENT DOCUMENTS

| | | | |
|---|---|---|---|
| 2,412,332 | 12/1946 | Hansen | 206/37 |
| 2,491,617 | 12/1949 | Lebach | 206/252 |
| 3,378,134 | 4/1968 | Wilkinson et al. | 220/20 |
| 3,611,602 | 10/1971 | Gandelman et al. | 40/117 |
| 3,618,559 | 11/1971 | Moe | 206/538 |
| 3,866,796 | 2/1975 | Bozek | 206/1.5 |

*Primary Examiner*—William T. Dixson, Jr.

*Attorney, Agent, or Firm*—Berman, Aisenberg & Platt

[57] ABSTRACT

A dispenser for oral medication which promotes patient compliance with prescribed treatment and dosage regimens. A housing has an opening formed therein through which may be viewed a plurality of individually defined compartments or wells within each of which are placed tablets or capsules corresponding to desired individual dosages. The plurality of compartments are arranged in a regular, preferably matrix, form so as to define a plurality of columns and rows of compartments which may respectively correspond to and be labeled with the particular day and time of day at which the individual dosages are desired to be dispensed. Means are provided for preventing manual accessability to all but a single day's worth of dosages. Each day's dosages may be successively selected by means of a child-proof advancing mechanism. The individual dosages within each day's dosages may be selected by the patient via a plurality of individual manually pivotable preferably transparent lids. The patient, pharmacist, and/or doctor may ascertain at a glance whether the desired treatment regimen has been complied with.

15 Claims, 6 Drawing Figures

COMPLIANCE DISPENSER FOR ORAL MEDICATION

BACKGROUND OF THE INVENTION

1. Field of the Invention

This invention is related to dispensers and, more particularly, is directed towards a compliance dispenser for oral medication which features a child-proof daily dosage advancing mechanism.

2. Description of the Prior Art

Too little attention has been paid in the art to devices which promote patient compliance with medication treatment regimens prescribed by physicians and designed to be administered in the home. Presently utilized pill and capsule dispensers generally comprise cylindrical containers provided with a child-proof cap and within which the pharmacist places the total prescribed amount of medication along with a label that reflects the prescribed treatment regimen, such as, for example, two capsules every four hours four times a day.

The patient unfortunately frequently has difficulty in remembering from day to day the proper times for taking his medication. This leads to situations where the patient may be taking his medication at time intervals too closely spaced as well as those where a patient may intentionally omit a dosage at a particular time in the fear that he has already taken same. Further, there is the ever-present possibility that a patient may simply unintentionally forget to take the prescribed dosage. It is even conceivable that certain patients might be forgetful enough such that dosages may be inadvertently doubled, or otherwise improperly taken.

The foregoing problems are clearly multiplied in those not infrequent cases when a patient finds himself simultaneously under prescription to two or more different medications. Here it is even more difficult to remember the amounts and times of day to take the various pills and/or capsules.

The foregoing all results from the fact that the presently utilized dispensers provide no means whatsoever to assist the patient in remembering when or if a particular medication should be or has been taken.

It is clear, therefore, that a great need exists for a device which would prevent or at least greatly decrease the possibility of the foregoing and other dosage-taking irregularities from happening.

OBJECTS AND SUMMARY OF THE INVENTION

It is therefore a primary object of the present invention to provide a dispenser for oral medication which promotes patient compliance with prescribed treatment regimens.

It is a further object of the present invention to provide a compliance dispenser for oral medication which assists the patient in remembering the desired days, times, and amounts of dosages prescribed.

An additional object of the present invention is to provide an inexpensive, child-proof dispenser for oral medication such as tablets and/or capsules, which provides a positive visual stimulus in helping patients remember when to take the next dosage of medication, as well as how much to take.

A still further object of the present invention is to provide a compliance dispenser for oral medication which gives the physician a method of instruction for initiation of the patient to maintenance medication to assure the patient and physician a greater adherence to the prescribed dosages.

The foregoing and other objects are achieved in accordance with one aspect of the present invention through the provision of a compliance dispenser for oral medication which comprises means for containing a plurality of individual dosages of oral medication that includes a plurality of compartments generally arranged in groups. The dispenser further includes means for selecting a single group of said compartments from among the plurality to allow dispensation of dosages therefrom, as well as means for selectively permitting access to an individual compartment from among the selected group of compartments. The group selecting means comprises means for covering all but one of the groups of compartments and includes means for selectively moving the covering means so as to individually render successive ones of the groups accessible.

In accordance with other aspects of the present invention, the plurality of compartments are arranged in a row and column-like fashion, each column corresponding to a particular day the medication is desired to be dispensed, each row corresponding to a particular time of day at which the prescribed individual dosages appearing in each compartment are to be taken by the patient. The individual compartments are hence preferably arranged in a regular, matrix-like fashion, while the covering means preferably comprises an endless transparent belt wrapped about the container means. An aperture is formed in the belt which corresponds in size to a single column of compartments. Means are provided for selectively moving the belt from one column to another as successive days of medication are taken by the patient.

In accordance with still other aspects of the present invention, the means for selectively permitting access to an individual compartment comprises a plurality of individually operable lids which correspond in number to the number of compartments in a single column, the maximum number of which would be the maximum number of times the prescribed medication is to be taken during a single day. The lids are pivotally mounted to a pivot support connected to the belt adjacent its aperture, a snap-lock closure member being positioned adjacent the opposing edge of the aperture for retaining the lids normally closed.

In accordance with still other aspects of the present invention, the belt may be selectively moved so as to successively position the aperture and hence plurality of lids over successive columns of compartments. The mechanism for moving the belt is preferably a child-proof mechanism for substantially impeding the operation thereof by an average child. The mechanism includes a hollow shaft having at least one sprocketed wheel formed thereabout for cooperable engagement with a plurality of sequentially formed conformable perforations in said belt. A manually actuable handle means include a pin formed therein for selective engagement with a similarly sized slot formed in the shaft, the handle being laterally positionable within the hollow shaft. A spring is also positioned within the shaft for normally biasing the pin of the handle out of engagement with the slot. A second sprocketed wheel may be connected to the shaft at its distal end so as to be rotatable therewith for engaging a second series of sequentially positioned perforations along the belt.

The entire belt, advancing mechanism, and plurality of lids may be mounted within a plastic housing by the pharmacist after the pills have been inserted in their respective compartments according to the desired treatment regimen. The housing may be closed by a substantially tamper-proof closure member. The child-proof advancing handle extends externally of the plastic housing for convenient access.

BRIEF DESCRIPTION OF THE DRAWINGS

The foregoing as well as other objects, aspects, uses, and advantages of the present invention will be more fully appreciated as the same becomes better understood when considered in connection with the following detailed description of the present invention viewed in conjunction with the accompanying drawings, in which.

DETAILED DESCRIPTION OF THE PREFERRED EMBODIMENTS

Figure 1:
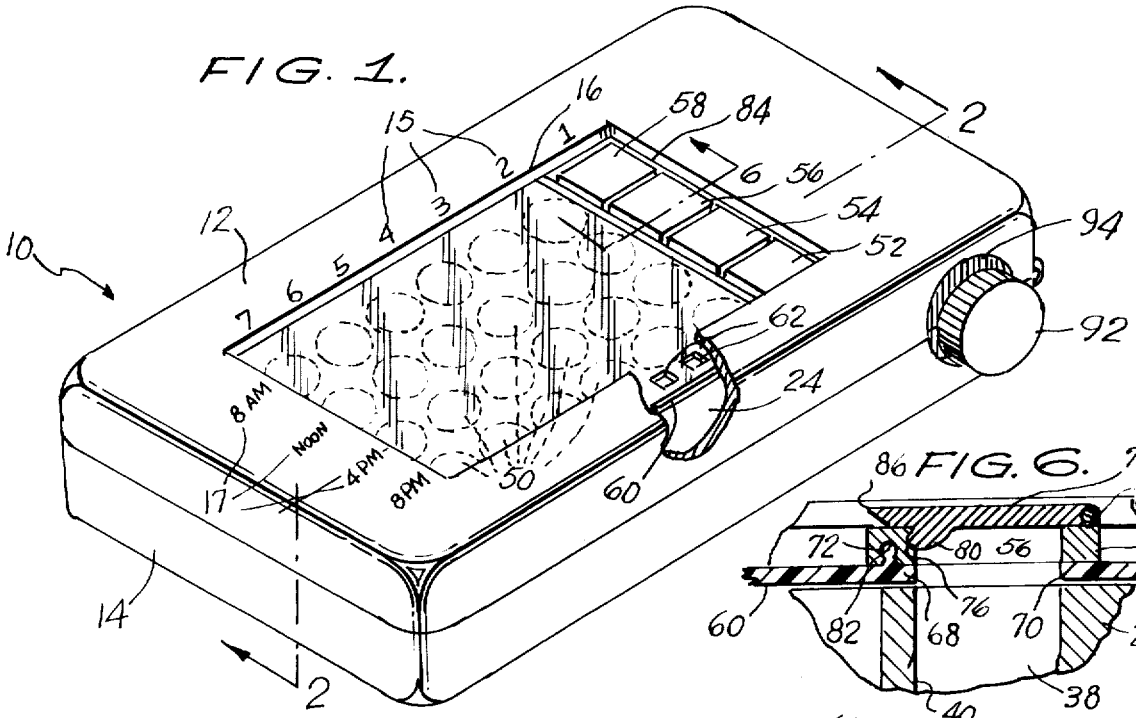
FIG. 1 is a perspective view, partially cut-away, of a preferred embodiment of the compliance dispenser in accordance with the present invention.

Referring now to the drawings, wherein like reference numerals represent identical or corresponding parts throughout the several views, and more particularly to FIG. 1, the compliance dispenser for oral medication is indicated generally by the reference numeral 10.

Figure 2:
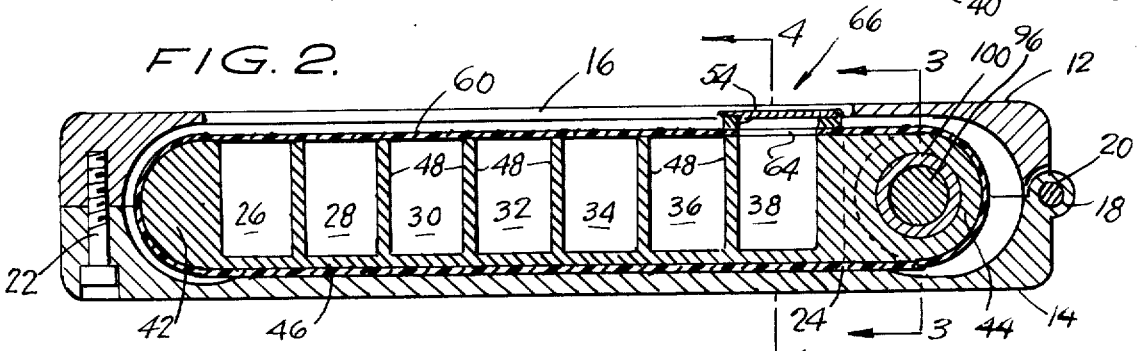
FIG. 2 is a sectional view of the preferred embodiment illustrated in FIG. 1 and taken along line 2—2 thereof.

The compliance dispenser 10 includes a housing which consists of an upper half 12 and a lower half 14. Housing halves 12 and 14 are pivotally joined at one end thereof by a pivot bearing 18 and a pivot pin 20 which form a hinge for the housing halves (FIG. 2). The housing is preferably comprised of a lightweight durable plastic and includes rounded corners as illustrated. Located on the opposite end to pivot members 18 and 20 are one or more set screws 22 for holding housing halves 12 and 14 together. It may be desirable to provide a set screw 22 which has an Allen head, or other non-conventional difficult to manipulate removing means, to make it more difficult to open housing heads 12 and 14.

Upper housing half 12 includes a substantially rectangular centrally formed window opening 16. Viewable through opening 16 are a plurality of dosage wells or pill compartments 50 which are preferably arranged in a regular, matrix-like, lattice having a plurality of regularly spaced rows and columns.

The dosage wells or pill compartments 50 (FIG. 1) are formed, either by drilling or molding techniques, in a removable compartmented member 24 which is also preferably comprised of plastic. Member 24 is sized so as to fit within the upper and lower housing halves 12 and 14, as best viewed in FIG. 2.

In the mode illustrated in FIG. 1, removable compartment member 24 defines twenty-eight individual wells or compartments 50 arranged in seven columns and four rows. The top surface of upper housing half 12 is designed so as to enable a user of the compliance dispenser 10 to label the columns and rows of compartments 50 at a point adjacent the opening 16. These labels, indicated for example by reference numerals 15 and 17, may correspond to the desired days of medication and the desired times that the medication is to be taken by the patient.

In the embodiment illustrated, the horizontally spaced column labels 15 are consecutively numbered from right to left to correspond to the particular day for which the medication is to be taken. Alternatively, the labels may reflect the particular days of the week or other convenient designation. The four vertically spaced rows 17, each consisting of seven compartments, are labeled according to the time of day at which the prescribed medication appearing in the associated compartments is desired to be taken. In other words, by virtue of the labels 15 and 17, each compartment 50 may contain a uniquely prescribable unit dosage for a particular day and time of day, which dosages may vary from day to day or from time to time, such that the compliance dispenser of the present invention assists the patient in remembering, with no effort, the correct amount of medication(s) to be taken at each dosage interval. As is more common, however, the amount of medication may remain constant over the treatment interval in which event the compliance dispenser 10 of the present invention nevertheless serves as a highly effective visual reminder to the patient that a particular dosage has or has not been taken.

Figure 4:
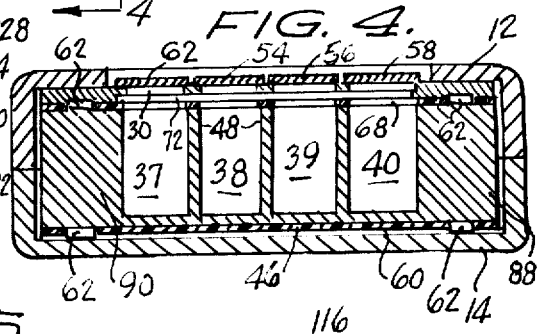
FIG. 4 is another cross-sectional view of the preferred embodiment compliance dispenser depicted in FIG. 2 and taken along line 4—4 thereof.

Referring now more particularly to FIGS. 2 and 4, the removable compartmented member 24 is defined in more detail and includes a pair of rounded ends 42 and 44, a base 46, and divider walls 48. Divider walls 48 may be either planar or curvilinear depending upon the manner of fabrication of member 24, divider walls 48 defining the plurality of compartments or dosage wells 50. Illustrated in FIG. 2 are one row of dosage wells 50 which correspond to those labeled "4 PN" and are indicated by reference numerals 26, 28, 30, 32, 34, 36 and 38. It is seen in FIG. 2 that these seven dosage wells are sized to accommodate either a single or a plurality of pills or capsules of oral medication.

As seen in FIG. 4, member 24 also includes a pair of sidewalls 88 and 90 between which are defined the individual columns of compartments 50, FIG. 4 illustrating the first column of four compartments 37, 38, 39 and 40 labeled day "1" in FIG. 1.

Referring back to FIG. 2, disposed about the rounded ends 42 and 44 of removable compartmented member 24 is a substantially endless belt 60 which is preferably comprised of a transparent film-like plastic, but which may be opaque if dictated by the particular medicine to be placed within compartmentss 50. Belt 60 is wrapped about member 24 and includes a pair of lateral facing terminating edges 68 and 70 (FIG. 6) which are joined by a pivotable lid assembly indicated generally by the reference numeral 66 in FIG. 2. The lateral edges 68 and 70 of belt 60 form a substantially rectangular, one-column wide opening or aperture 64 in belt 60. Aperture 64 is sized similarly to the width and length of a single column of compartments which correspond to a single day's medication.

As best seen in FIG. 1, belt 60 also includes a plurality of regularly spaced perforations 62 which are preferably formed along both edges thereof and are engageable by a manually actuable drive mechanism to be described in more detail hereinafter.

Figure 6:
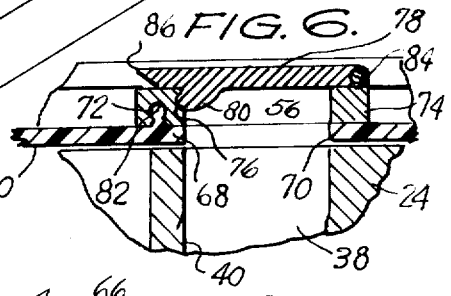
FIG. 6 is an enlarged sectional view illustrating the detail of construction of the individually operable lid members in accordance with the preferred embodiment of the present invention.

Referring now to FIGS. 1 and 2 and, for more detail, FIG. 6, the pivotable lid assembly 66 is seen to be comprised in this preferred embodiment of a plurality of preferably transparent individually and manually operable lid members 52, 54, 56 and 58. Extending laterally along edge 68 of belt 60 is a retainer member 72, while extending substantially parallel to retainer member 72 along opposing edge 70 of belt 60 is a mounting member 74. Retainer member 72 includes a resilient lip-receiving edge 76 and a resiliency-imparting recess 82 integrally formed therein.

Lid member 56 is seen to include a planar top portion 78, a snap-fit closure lip member 80, a pivot hinge 84, and a projecting tapered tip 86 for facilitating finger actuation thereof. Pivot hinge 84 is mounted on mounting member 74, and snap-fit closure lip 80 is designed to cooperate with the resilient lip-receiving edge 76 of retainer member 72 as clearly illustrated in FIG. 6.

It is seen that the lids 52, 54, 56 and 58 are each independently pivotable from a fully closed snap tight shut position to a fully open position so as to provide easy access when open to the underlying particular compartment, such as compartment 38 in FIG. 6, of the compartmented member 24. The lids 52–58 are desinged so as to cover one and only one compartment each, such that opening of same will expose only the dosage of that compartment over which it is placed. Obviously, either greater or fewer rows and columns and corresponding lid members may be provided as desired.

Figure 3:
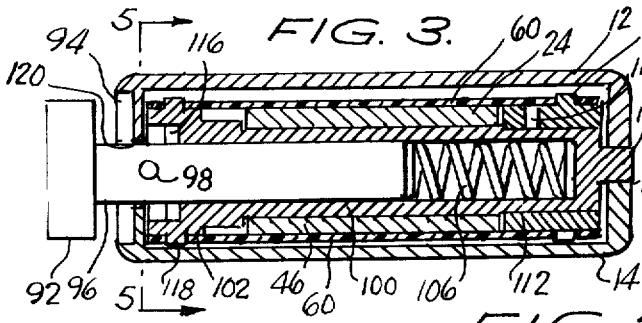
FIG. 3 is a cross-sectional view of the compliance dispenser of the present invention more particularly illustrating the advancing mechanism thereof and taken along line 3—3 of FIG. 2.

Referring now to FIGS. 1 and 3, protruding through an aperture 120 formed in upper and lower housing halves 12 and 14 is a film and lid advancing child-proof knob 92 which is preferably knurled on its outer surface to facilitate the gripping thereof. Knob 92 has a correspondingly sized knob-receiving recess 94 formed in upper and lower housing mebers 12 and 14.

Referring now to FIG. 3, the structural details of the child-proof film advancing mechanism will now be described. Knob 92 is formed on the end of a shaft 96 which extends within a hollow rotatable tubular member 100. Shaft 96 has an actuating pin 98 (FIG. 5) extending therethrough whose function will become more clear hereinafter. Shaft 96 is spring-loaded within tubular member 100 by virtue of a spring 106 seated firmly against the distal end of member 100 and the end of shaft 96.

A somewhat reduced diameter distal end 110 of rotatable tubular member 100 extends through an aperture 122 formed in the far side wall of housing halves 12 and 14 for supporting the actuating mechanism.

Figure 5:
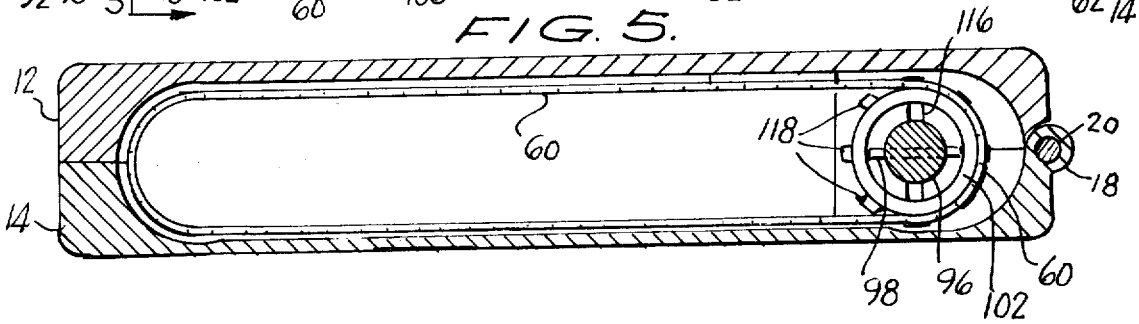
FIG. 5 is a side-sectional view of the preferred embodiment of the compliance dispenser of the present invention illustrating other structural detail and taken along line 5—5 of FIG. 3.

Preferably integrally formed at one end of the rotatable tubular member 100 is a sprocket wheel 102 which includes a plurality of sprocket pins 118 formed at regular spaced intervals thereabout (FIG. 5). Integrally formed in rotatable tubular member 100 adjacent the knob end of shaft 96 is a pin-receiving slot 116 which is sized to receive pin 98 of shaft 96.

Tubular member 100 also has preferably formed at the distal end thereof a second sprocket wheel 112 having a plurality of sprocket pins 128 formed thereabout. Sprocket wheel 112 is illustrated as being secured to shaft 100 by virtue of a retainer pin 114.

The sprocket pins 118 and 128 coact with the perforations 62 formed in the edges of film 60 for advancing same when the shaft 100 is rotated.

In operation, manual rotation of knob 92 in its position illustrated in FIG. 3 will not result in rotatable movement of shaft 100 due to the disengagement of pin 98 with pin-receiving slot 116, thereby rendering the advancing mechanism child-proof. In order to rotate tubular member 100 so as to actuate the sprocket wheels 102 and 112 to move film 60 and hence lid members 52, 54, 56 and 58, a knowledgeable adult must first counteract the force presented by spring 106 by exerting pressure on knob 92 in a rightward direction as viewed in FIG. 3 and, in addition, must rotate knob 92 until pin 98 is engaged by slot 116. Further rotation under force will result in rotational movement of shaft 100, hence sprocket wheels 102 and 112, and will cause movement of film 60 and associated lid assembly 66 to the desired position. Any release of pressure upon knob 92 while rotating will normally cause pin 98 to be withdrawn from slot 116 under the leftward force exerted by spring 106 to thereby render the mechanism non-advanceable.

Once the proper column has been selected, it is a simple matter for the patient to know by visual observation as to which of the prescribed dosages have or have not been taken. Manual accessability to only a single dose at a time prevents an overdose, and at the same time ensures that the prescribed dose is taken at the proper time.

It is seen that we have provided an extremely useful and unique compliance dispenser for tablets, capsules, and other oral pharmaceuticals which may be utilized by the physician, pharmacist and patient alike to increase the likelihood that the medications will be taken as prescribed at the appropriate time of day for the indicated number of days. The compliance dispenser of the present invention additionally provides the physician with a method of instruction for initiating the patient to maintenance medication, such as hypertensives, oral hypoglycemics, anti-convulsives, oral contraceptives, and the like. The visual contact with the next dose and time is a positive factor and stimulus in assisting the patients to conform to the prescribed treatment regimen. It also facilitates adherence by the patient on limited regimens of medications such as antibiotics, pain relievers, antihistamines, tranquilizers, and the like. The present invention further assists the pharmacist in providing a tool in his effort to get the prescribed medication into the patient at the right time and at the right intervals.

The device of the present invention may be utilized in conjunction with an overall treatment scheme whereby the prescribed medication may be dispensed directly in the compliance dispenser 10. The physician may specify utilization of compliance dispenser of the present invention on his prescription form with a self-adhering label, for example, which may be easily transferred to the underside of the dispenser and will bear the appropriate instructions to the pharmacist to enable the latter to conduct a compliance interview with the patient. In other words, the compliance dispenser of the present invention provides a new dimension to the pharmacist in his efforts to upgrade his professional dispensing techniques both in the pharmacy and in a hospital. The physician likewise has greater confidence in his prescription effectiveness when he is assured that a competent member of his health team is checking and rechecking for compliance. The device of the present invention will therefore increase patient compliance with prescribed oral medications at very little cost.

The present invention is also useful in research medicine wherein the drug manufacturers are interested in obtaining more precise techniques to follow a drug through the stages of trial. The compliance dispenser in this instance provides an exact milligram count of medicine taken by each patient, and provides the researcher with a new colleague in the form of the pharmacist's follow-up compliance interview.

Obviously, numerous variations and modifications of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A compliance dispenser for oral medication, which comprises:

means for containing a plurality of individual dosages of oral medication which includes dosage compartments arranged in groups, each group including a plurality of dosage compartments;

means for selecting one group of said dosage compartments from among said groups of compartments for allowing dispensation of said dosages therefrom, said selecting means comprising belt means movably disposed across said plurality of dosage compartments, said belt means having an opening formed therein which permits access only to one selected group of dosage compartments at a time; and manually operable lid means for selectively permitting access to an individual dosage compartment within said selected group of dosage compartments, said lid means positioned over said opening in said belt means and connected to said belt means so as to be moveable therewith.

2. The compliance dispenser as set forth in claim 1 further comprising means for selectively moving said belt means so as to individually render successive ones of said groups accessible to a user.

3. The compliance dispenser as set forth in claim 2 wherein said means for selectively moving said covering means includes child-proof means for substantially impeding the operation thereof by an average child.

4. The compliance dispenser as set forth in claim 1 wherein said lid means comprises a plurality of individually operable lids corresponding in number to the number of dosage compartments in a group of said dosage compartments.

5. The compliance dispenser as set forth in claim 5 wherein each of said individually operable lids is pivotally mounted to a pivot support connected to said belt means adjacent said opening means.

6. The compliance dispenser as set forth in claim 5 wherein said lid means includes hinge means positioned along an edge of said opening about which each of said lids is pivotable, and snap-fit means positioned along an opposite edge of said opening for retaining said lids in a normally closed compartment-covering position.

7. The compliance dispenser as set forth in claim 6 wherein said means for moving said belt means comprises rotatable means for engaging said belt so as to cause same to move therewith, and wherein said child-proof means includes manually actuable handle means for selective engagement with said rotatable means.

8. The compliance dispenser as set forth in claim 7 wherein said rotatable means comprises a shaft which includes at least one sprocketed wheel formed thereabout; said belt including a plurality of sequentially positioned conforming perforations for cooperable engagement with said sprocketed wheel.

9. The compliance dispenser as set forth in claim 8 wherein said shaft is hollow and has said handle means positioned therein, said handle means including a pin formed therein for selective engagement with a similarly sized slot formed in said rotatable means.

10. The compliance dispenser as set forth in claim 9 wherein said child-proof means further comprises spring means positioned within said hollow shaft for normally biasing said pin out of engagement with said slot.

11. The compliance dispenser as set forth in claim 8 wherein said shaft is elongate and has said at least one sprocketed wheel integrally formed at one end thereof.

12. The compliance dispenser as set forth in claim 11 further comprising a second sprocketed wheel connected to said shaft at its distal end so as to be rotatable therewith to engage a second series of sequentially positioned perforations along said belt means.

13. The compliance dispenser as set forth in claim 1, further comprising child-proof means for normally substantially impeding the movement of said opening in said belt means from one group of dosage compartments to another.

14. The compliance dispenser as set forth in claim 1, further comprising a housing for enclosing said containing means and said belt means, said housing having an access aperture which defines the limits of movement of said lid means.

15. A compliance dispenser for oral medication, which comprises:

means for containing a plurality of individual dosages of oral medication which includes a plurality of separate compartments arranged in m rows and n columns throughout which said plurality of individual dosages of oral medication may be distributed in accordance with a desired treatment regimen;

means for selecting one column of compartments from said n columns for allowing dispensation of said individual dosages from the m compartments within said one column, said selecting means comprising movable means for covering all but one of said n columns of compartments and child-proof means for normally substantially impeding the movement of said movable covering means from one of said columns to another;

a plurality of manually operable lid means for selectively permitting access to one of said m compartments within said one selected column of compartments; and a housing for enclosing said containing means and having an opening therein within which said plurality of compartments are made selectively accessible by movement of said movable covering means.

* * * * *